US010340107B2

(12) United States Patent
Schertler et al.

(10) Patent No.: US 10,340,107 B2
(45) Date of Patent: Jul. 2, 2019

(54) ARRANGEMENT FOR AN ELECTRIC SWITCHING DEVICE

(71) Applicants: TE Connectivity Germany GmbH, Bensheim (DE); Tyco Electronics Componentes Electromecanicos Lda., Evora (PT)

(72) Inventors: Katrin Schertler, Dallgow-Doberitz (DE); Andreas Hendler, Berlin (DE); Uwe Kramer, Schulzendorf (DE); Titus Ziegler, Berlin (DE); Harry Koch, Berlin (DE); Bernd Rahn, Borgsdorf (DE); Luis Sandoval, Evora (PT); Pedro Silva, Evora (PT)

(73) Assignees: Tyco Electronics Componentes Electromecanicos Lda., Evora (PT); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/009,139

(22) Filed: Jan. 28, 2016

(65) Prior Publication Data

US 2016/0225566 A1 Aug. 4, 2016

(30) Foreign Application Priority Data

Jan. 30, 2015 (DE) ..... 10 2015 201 700
Apr. 30, 2015 (DE) ..... 10 2015 208 134

(51) Int. Cl.
*H01H 50/30* (2006.01)
*H01H 50/26* (2006.01)
*H01H 50/28* (2006.01)

(52) U.S. Cl.
CPC ..... *H01H 50/30* (2013.01); *H01H 50/26* (2013.01); *H01H 50/28* (2013.01)

(58) Field of Classification Search
CPC ..... H01H 50/642; H01H 50/56
(Continued)

(56) References Cited

U.S. PATENT DOCUMENTS 2,471,181 A 5/1949 Wilson
5,719,541 A * 2/1998 Mader ..... H01H 50/642 200/17 R
(Continued)

FOREIGN PATENT DOCUMENTS

EP 0777250 A2 6/1997
JP 5491640 12/1977
(Continued)

OTHER PUBLICATIONS

European Search Report, dated Jun. 27, 2016, 9 pages.
(Continued)

*Primary Examiner* — Alexander Talpalatski
(74) *Attorney, Agent, or Firm* — Barley Snyder

(57) ABSTRACT

An arrangement for an electric switching device is disclosed. The arrangement for an electric switching device comprises a switching unit having a first switching position and a second switching position, a restoring element exerting a restoring force on the switching unit in the second switching position, and a return spring fastened to the switching unit and exerting a counterforce on the switching unit. The restoring force is directed toward the first switching position, while the counterforce acts opposite to the restoring force.

12 Claims, 14 Drawing Sheets

(58) Field of Classification Search
USPC ..... 335/78
See application file for complete search history.

(56) References Cited

U.S. PATENT DOCUMENTS

| | | | | |
|---|---|---|---|---|
| 5,864,269 | A | 1/1999 | Grueber et al. | |
| 6,246,306 | B1 * | 6/2001 | Gruner | C22C 9/00 335/129 |
| 6,606,018 | B2 * | 8/2003 | Takano | H01H 50/026 335/78 |
| 7,986,204 | B2 * | 7/2011 | Mader | H01H 50/043 335/78 |
| 8,237,523 | B2 * | 8/2012 | Helmreich | H01H 50/548 200/400 |
| 8,373,524 | B1 * | 2/2013 | Villarin | H01H 1/225 335/78 |
| 8,558,647 | B2 * | 10/2013 | Shinkai | H01H 11/00 335/78 |
| 8,816,800 | B2 * | 8/2014 | Mikl | H01H 50/56 335/83 |
| 9,224,562 | B2 * | 12/2015 | Naumann | H01H 57/00 |
| 2014/0062626 | A1 | 3/2014 | Saito et al. | |

FOREIGN PATENT DOCUMENTS

| | | | |
|---|---|---|---|
| JP | 6080644 | U | 6/1985 |
| JP | 6154131 | A | 3/1986 |
| JP | 0644881 | A | 2/1994 |
| JP | 2001023496 | A | 1/2001 |

OTHER PUBLICATIONS

Abstract of JP 2001023496, dated Jan. 26, 2001, 1 page.
English translation of claims for JP54091640U, dated Dec. 12, 1977, 1 page.
European Patent Office Communication, Application No. 16 152 815.3-1204, dated May 8, 2019, 4 pages.

* cited by examiner

ARRANGEMENT FOR AN ELECTRIC SWITCHING DEVICE

CROSS-REFERENCE TO RELATED APPLICATIONS

This application claims the benefit of the filing dates under 35 U.S.C. § 119(a)-(d) of German Patent Application No. 102015201700.1, filed Jan. 30, 2015, and German Patent Application No. 102015208134.6, filed Apr. 30, 2015.

FIELD OF THE INVENTION

The invention relates to an arrangement for an electric switching device, and more particularly, to an arrangement for an electric switching device with at least one switching unit.

BACKGROUND

Switching devices known in the prior art have at least one switching unit which is movable from a first switching position into a second switching position. Known switching devices often have a restoring element which, at least in the second switching position, exerts a restoring force directed towards the first switching position and acting on the switching unit. Such a restoring element can be, for example, a restoring spring. The restoring element attempts to move the switching unit into the first switching position; this movement is normally stopped by a stop. However, a loud noise is generated by the impact on the hard stop, limiting use of such switching devices in environments in which such noises can disturb or distract a user such as, for example, in vehicle interiors.

SUMMARY

An object of the invention, among others, is to provide an arrangement for an electric switching device capable of switching more quietly. The disclosed arrangement for an electric switching device comprises a switching unit having a first switching position and a second switching position, a restoring element exerting a restoring force on the switching unit in the second switching position, and a return spring fastened to the switching unit and exerting a counterforce on the switching unit. The restoring force is directed toward the first switching position, while the counterforce acts in a direction opposite to the restoring force.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an arrangement for an electric switching device. This invention may, however, be embodied in many different forms and should not be construed as limited to the embodiments set forth herein; rather, these embodiments are provided so that this disclosure will be thorough and complete and still fully covey the scope of the invention to those skilled in the art.

Figure 1:
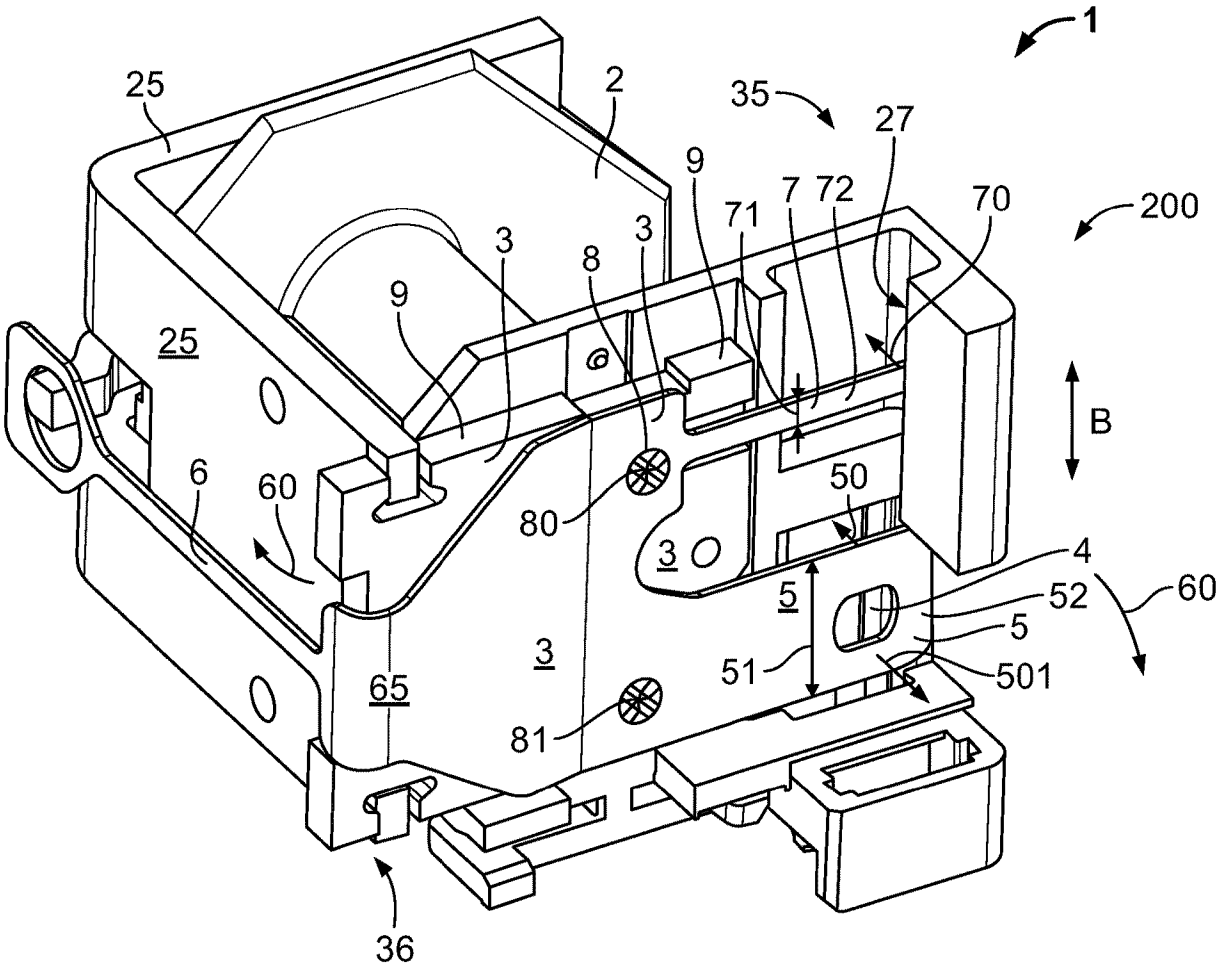
FIG. 1 is a schematic perspective view of an arrangement for an electric switching device according to the invention.
Figure 2:
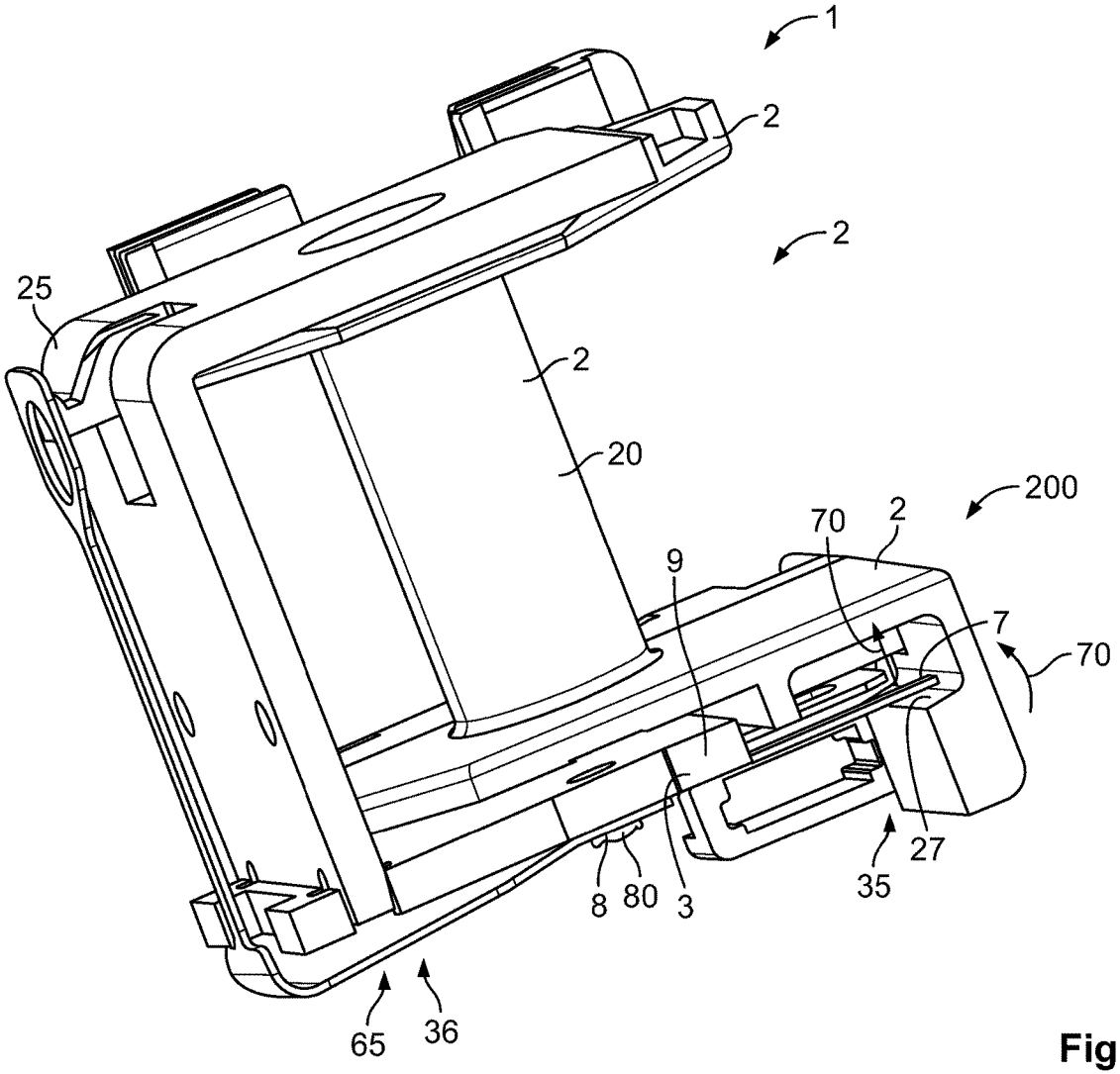
FIG. 2 is a schematic perspective view of the arrangement from FIG. 1.

An arrangement 1 for an electric switching device is shown generally in FIGS. 1 and 2. The arrangement 1 may be a relay. The arrangement 1 for an electrical switching device includes a coil body 2, a switching unit 3, a contact spring 5, a restoring element 6, and a return spring 7. The major components of the invention will now be described in greater detail.

The coil body 2 is an electromagnet including coil core 20 as shown in FIG. 2. In the illustration in FIGS. 1 and 2, only one coil body 2 is represented, but the arrangement 1 may have more than one coil body 2. The coil body 2 also has windings (not shown) generating a magnetic field.

Switching unit 3 comprises contact spring 5 and an armature 9. The switching unit 3 can be provided with a folding mechanism, such a folding mechanism can comprise a bearing or a joint on one side.

Return spring 7, contact spring 5 and restoring element 6 are part of a spring element 10. Spring element 10 may be manufactured from a metal sheet via punching and bending the metal sheet. The contact spring 5 and/or the return spring 7 and/or the restoring element 6 can also be configured as a leaf spring. Such a configuration is compact and easy to produce.

Restoring element 6 comprises a spring coil 65 or a spring bulge which, in the fitted state, is spaced apart from armature 9.

Contact spring 5 and return spring 7 comprise parallel limbs 52 or 72. Contact spring 5 and return spring 7 project at a distal end 35 of the switching unit. Distal end 35 is opposite a proximal end 36 on which armature 9 is fitted in an articulated manner on yoke 25.

Figure 5:
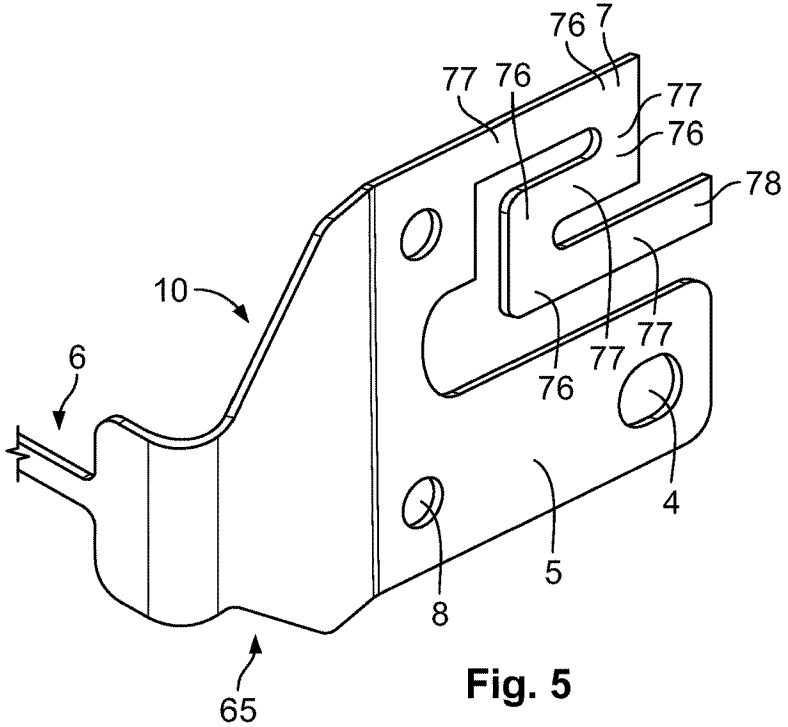
FIG. 5 is a schematic perspective view of a further embodiment of a spring element.
Figure 4:
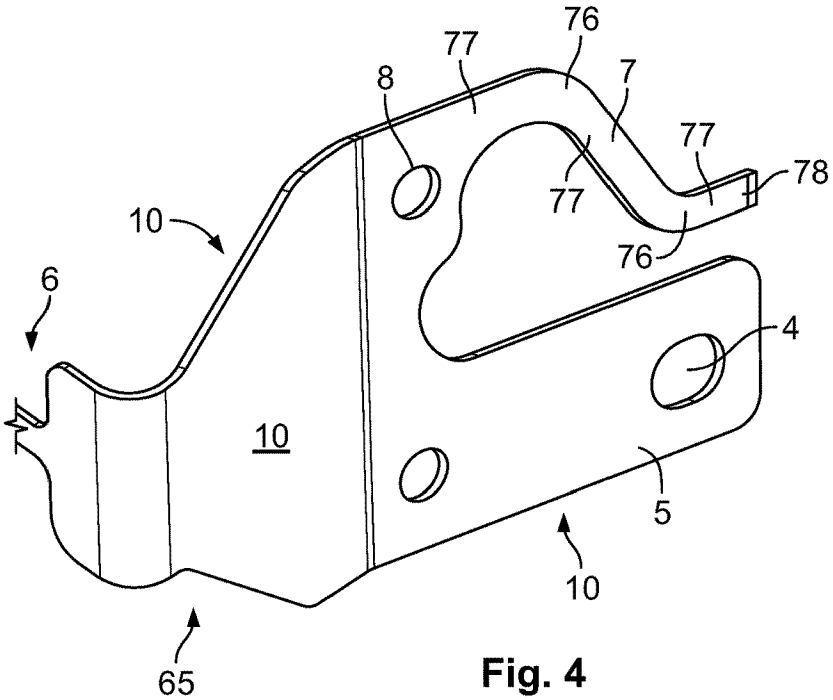
FIG. 4 is a schematic perspective view of a further embodiment of a spring element.

Return spring 7 has a lower spring constant than contact spring 5. The return spring 7 may have a smaller width 71 measured in a width direction B than width 51 of contact spring 5 measured in width direction B. The lever length, that is to say, the spacing between rivet 80 or 81 and a contact location, on which return spring 7 or contact spring 5 is supported, is in each case approximately equal. In another embodiment, a lower spring constant could also be achieved by a longer lever arm, that is to say that in the case of the contact spring the lever arm is shorter than in the case of return spring 7. In order to increase the resilient length, return spring 7 can also be embodied to be L-shaped or in a meandering fashion, as shown in FIGS. 4 and 5. The thickness of the springs could also be different. Moreover, the springs could be processed differently, for example, made softer or hardened.

Figure 7:
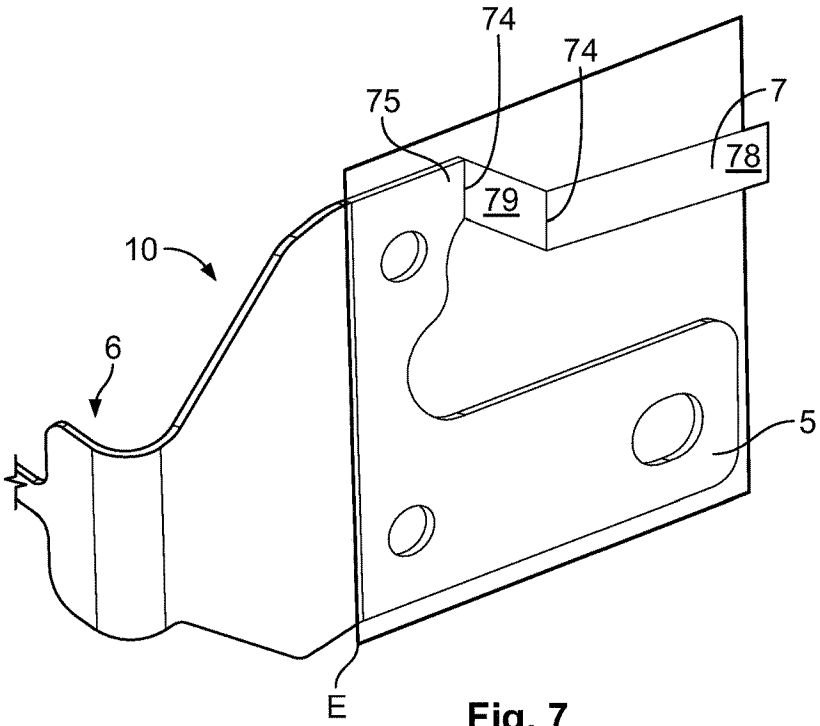
FIG. 7 is a schematic perspective view of a further embodiment of a spring element.
Figure 6:
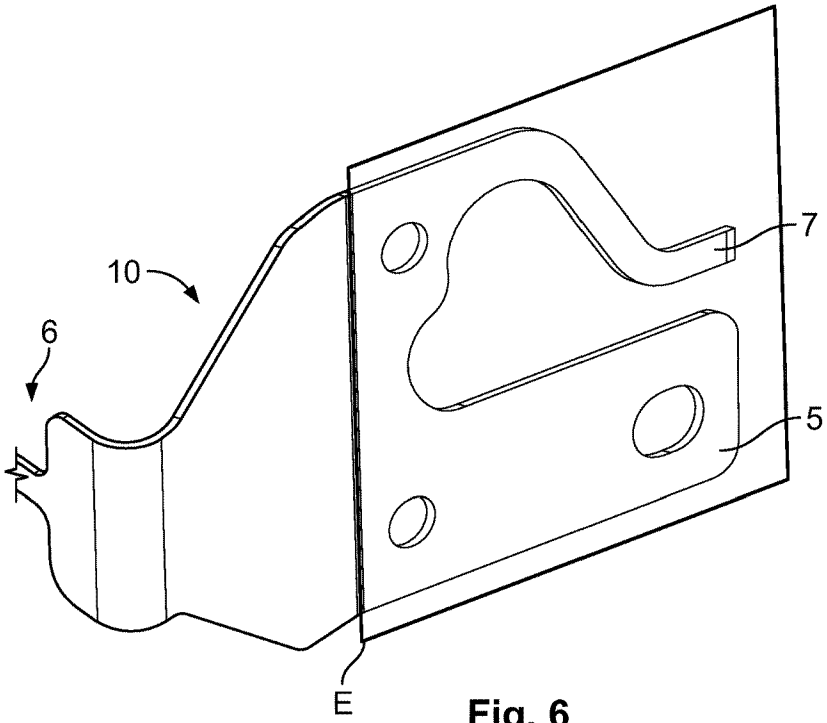
FIG. 6 is a schematic perspective view of the embodiment of a spring element from FIG. 4.

Return spring 7 and contact spring 5 can extend in a common plane E, as shown in FIG. 6, but the return spring 7 can, as a result of additional bends, also project out of this plane as is represented in FIG. 7.

The connections and assembly of the arrangement 1 for an electric switching device will now be described.

Spring element 10 is fastened to armature 9 via rivet 80 and a further rivet 81. Armature 9 is fastened foldably to yoke 25, which partially surrounds the coil body 2.

Return spring 7 is fastened to switching unit 3 via rivet 80. A fastening location 8 of return spring 7 with respect to the switching unit 3 varies, as will be described in further embodiments.

Return spring 7 is pretensioned and permanently abuts against supporting surface 27. Return spring 7 and contact spring 5 are supported on the same side. Contact spring 5 is supported on the load circuit via the contact element (not shown). Return spring 7 is supported on a supporting surface 27 or a stop. The arrangement can be kept compact as a result of the support on the same side. Limbs 52, 72 of the contact spring 5 and return spring 7 extend parallel with one another in order to enable a simple structure and to keep the flow of forces simple. For example, occurrences of twisting can be kept low as a result.

In order to achieve a particularly simple configuration, supporting surface 27 is located on coil body 2. Coil body 2 can be, for example, an injection-moulding element. Complex mounting processes are avoided by the attachment of supporting surface 27 to coil body 2. In one alternative configuration, supporting surface 27 could also be arranged on another element, for example, on an external element.

When current is applied via an activated coil of the coil body 2, it generates a magnetic field which in turn attracts a switching unit 3 and armature 9, and as a result moves it into second switching position 200 represented in FIGS. 1 and 2. A magnetic circuit which comprises coil core 20, a yoke 25 and armature 9 is thus closed. Arrangement 1 serves to control a load circuit with the aid of a control circuit comprising the coil.

In second switching position 200, a contact element (not shown) which is fitted in a receiving opening 4 is in contact with an element of a load circuit (not shown). A projecting contact spring 5 pushes on the contact element so that it abuts with a sufficiently high force and at a defined position.

The restoring element 6 in second switching position 200 exerts a restoring force 60 on switching unit 3. Restoring force 60 attempts to cause switching device 3 to move into a first switching position 100 not represented in FIGS. 1 and 2.

The return spring 7 exerts a counterforce 70 acting on switching unit 3. If the magnetic force generated by the coil drops by switching off the current, restoring element 6 attempts to push switching unit 3 out of second switching position 200 into first switching position 100. In order to avoid the switching unit generating a noise if it strikes a hard stop at the end of the movement, return spring 7 generates a counterforce 70 which changes with a deflection of switching unit 3 and which counteracts restoring force 60. As a result, the movement of switching unit 3 is braked. In first switching position 100, restoring force 60 and counterforce 70 balance each other out so that a balance of forces prevails and switching unit 3 is held in this balance of forces in a stop-free manner.

In particular, in second switching position 200 shown in FIGS. 1 and 2, the return spring 7 abuts against supporting surface 27 in order to avoid a noise which would be generated if return spring 7 were only to strike supporting surface 27 during the switching movement. In second switching position 200 shown here, a counterforce 70, even though only a small force, therefore already acts on switching unit 3.

If switching unit 3 is moved from second switching position 200 in the direction of first switching position 100, counterforce 70 is increased. In this case, restoring force 60 simultaneously decreases with increasing deflection. In first switching position 100, counterforce 70 and restoring force 60 compensate for each other and switching device 3 is in a balance of forces. At the same time, no switching force such as a magnetic force acts in first switching position 100. Switching device 3 is therefore gently braced and does not strike a stop hard as in the prior art. Development of noise is therefore avoided. Armature 9 and thus switching unit 3 can be moved from first switching position 100 into second switching position 200 by folding.

Figure 3A:
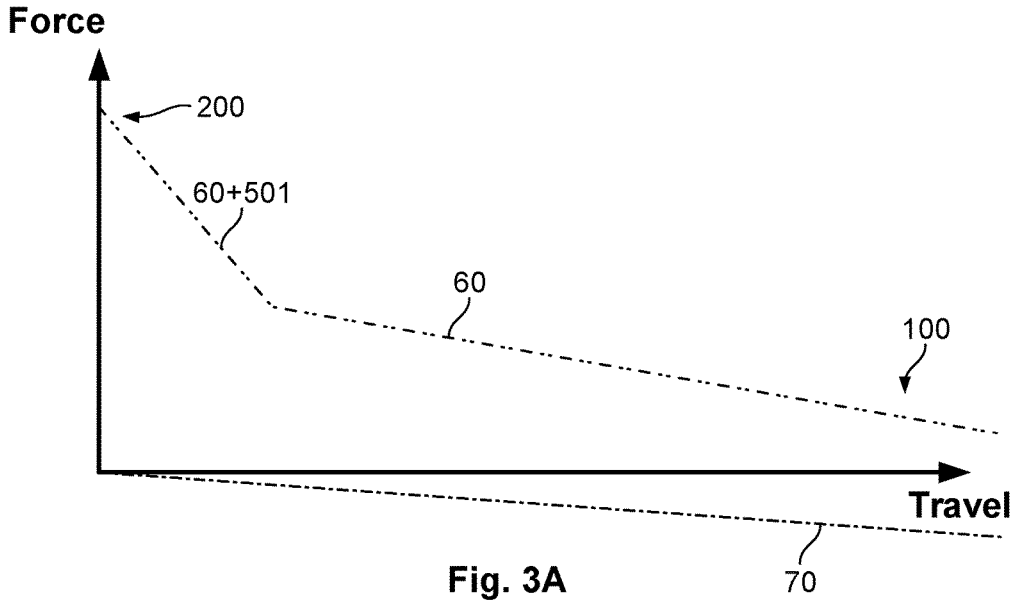
FIG. 3A is a curve of a restoring force and a counterforce between a first and second switching position of the arrangement from FIGS. 1 and 2.
Figure 3B:
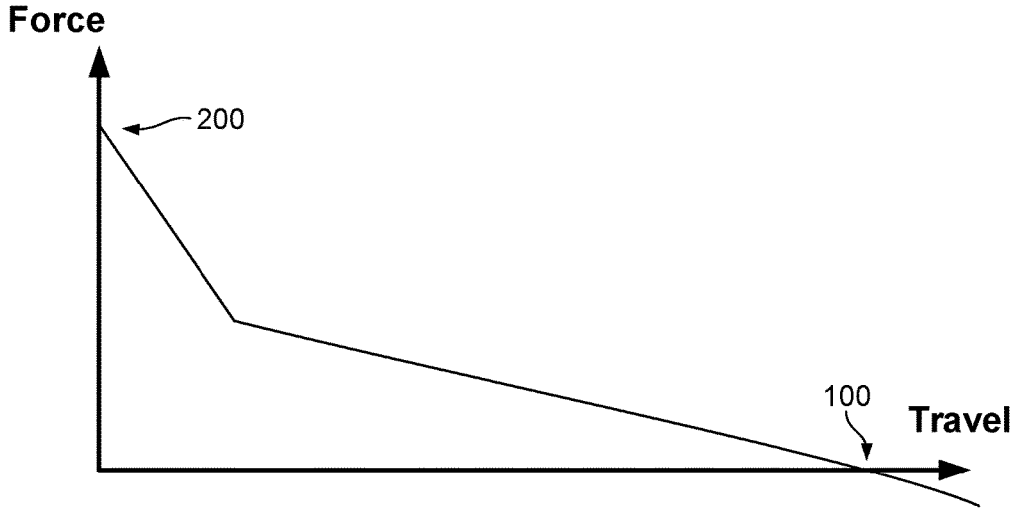
FIG. 3B is a curve of an overall force between the first and second switching position of the arrangement from FIGS. 1 and 2.

The travel-force characteristic curves are represented in FIGS. 3A and 3B in the case of a deflection of switching unit 3. The individual forces are represented in FIG. 3A, while the resultant total force is represented in FIG. 3B. Restoring force 60 decreases from second switching position 200 towards first switching position 100. In the region of second switching position 200, elastic force 501 of contact spring 5 acting counter to contact force 50 is also added to restoring force 60. Contact spring 5 has a higher spring rigidity than restoring spring 6 so that the travel-force characteristic curve extends at a very high gradient in this region. It ends at the ordinate at the location at which the force generated by the springs is equal to the magnetic force of the coil.

Counterforce 70 of return spring 7 counteracts restoring force 60 and is therefore negative. It increases in terms of magnitude with increasing deflection from second switching position 200 into first switching position 100. Since restoring force 60 reduces simultaneously in terms of magnitude, the point is reached at some time at which the magnitudes of the forces are identical, but the preceding signs are different. A balance of forces between counterforce 70 and restoring force 60 prevails there. First switching position 100 is located at this location. In contrast to the prior art, however, there is no stop here. The arrangement is therefore stop-free at first switching position 100. Switching unit 3 can be resiliently braced in first switching position 100.

Figure 3C:
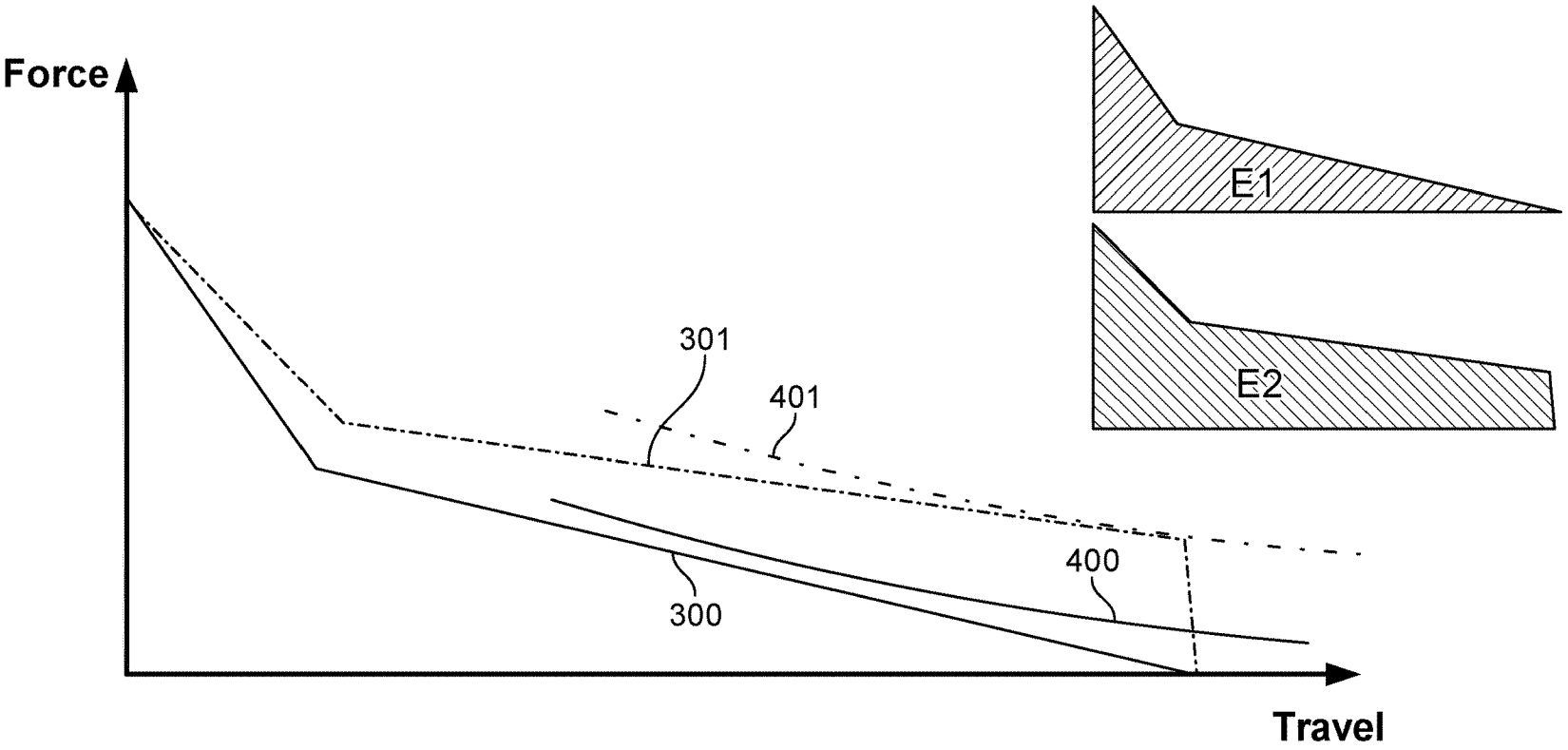
FIG. 3C is a curve of the arrangement from FIGS. 1 and 2 in comparison with travel-force characteristic curves of arrangements from the prior art and corresponding energies.

In FIG. 3C, by way of example, resilient characteristic curve 300 of a spring element 10 according to the invention is compared with typical resilient characteristic curve 301 of a make contact relay according to the prior art. The energies required are represented at the top right as inserts.

Figure 3E:
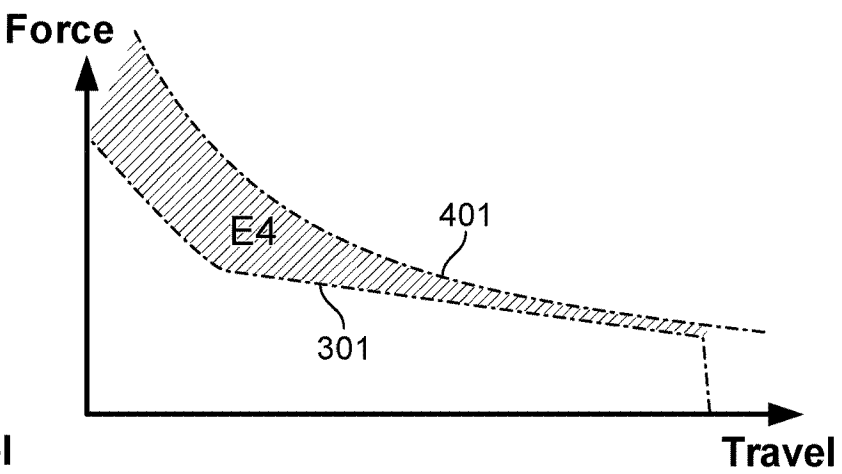
Fig. 3E PRIOR ART
FIG. 3E is a curve of spring elements and magnet drive systems from the prior art.
Figure 3D:
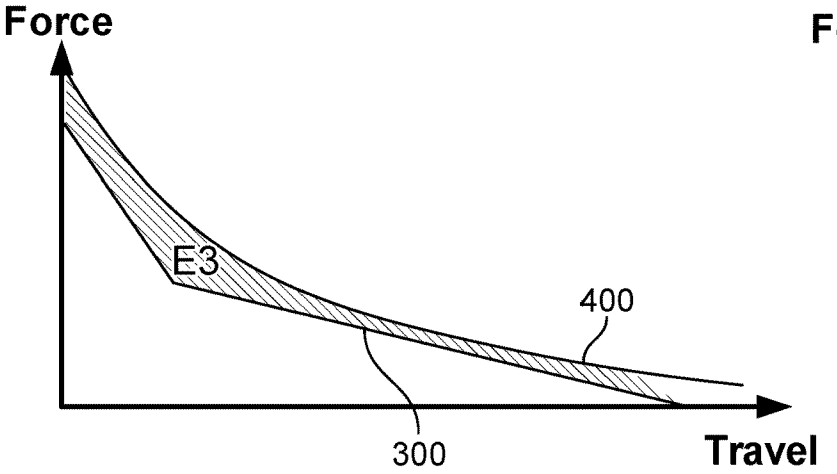
FIG. 3D is a curve of spring elements and magnet drive systems according to the invention.

As a result of the stop-free characteristic, spring energy E1 of spring element 10 according to the invention, which can be represented by the surface located under the curve, is reduced in comparison with spring energy E2 from the prior art. As a result, it is possible that characteristic curve 400 of a magnet drive system, which is used together with the arrangement according to the invention, has a lower response force than characteristic curve 401 of a magnet drive system from the prior art. A magnet drive system according to characteristic curve 400 can be constructed, as a result of this smaller response force, to be smaller and in a more material-saving manner, for example, in terms of winding and iron cross-section. In FIGS. 3D and 3E, spring forces 300 or 301 are represented in each case in pairs together with possible characteristic curves of associated magnet drive systems, such as, for example, coils.

FIG. 3D shows that resilient characteristic curve 300 of a spring element 10 according to the invention is better adapted in its profile to typical characteristic curve 400 of the magnet drive system, in contrast to FIG. 3E, with resilient characteristic curve 301 and magnet drive system characteristic curve 401 from the prior art. Excess energy E3 between resilient characteristic curve 300 according to the invention and magnet drive system characteristic curve 400 in FIG. 3D is lower than excess energy E4 in the case of the prior art according to FIG. 3E. As a result, the noise during stopping of armature 9 on core 20 can also be reduced in comparison with the prior art.

A further embodiment of a spring element 10 is represented in FIG. 4. In comparison with the embodiment from FIG. 1, here the return spring 7 is bent into an S- or L-shape in order to give return spring 7 a softer characteristic and to configure the switching process to be even more gentle. Here, return spring 7 has two curves 76 and straight sections 77 in order to allow simple spring characteristics during the switching movement.

A further embodiment of a spring element 10 is shown in FIG. 5. Return spring 7 is configured to be meandering so that particularly flexible switching characteristics are possible. Here, the return spring has four curves 76. As in the embodiment of FIG. 4, an end section 78 of return spring 7 extends parallel with contact spring 5 in order to make possible simple and reliable contacting.

The embodiment of FIG. 4 is represented again in FIG. 6. A plane E is additionally indicated in order to show that return spring 7 and contact spring 5 lie in a plane. Curves 76 and straight sections 77 lie in this plane. In the case of such a configuration, a particularly compact structure is possible.

In the case of the configuration according to FIG. 7, a part of return spring 7 lies outside plane E. A central section 79, which is connected via two 90° steps 74 to end section 78 and a starting section 75, projects perpendicularly out of plane E. Return spring 7 has an approximately Z-shaped profile. End section 78 is parallel with plane E and parallel with contact spring 5 in order to achieve simple switching. Alternatively to the shown configuration with steps 74, return spring 7 can also extend out of plane E via curves.

Figure 8:
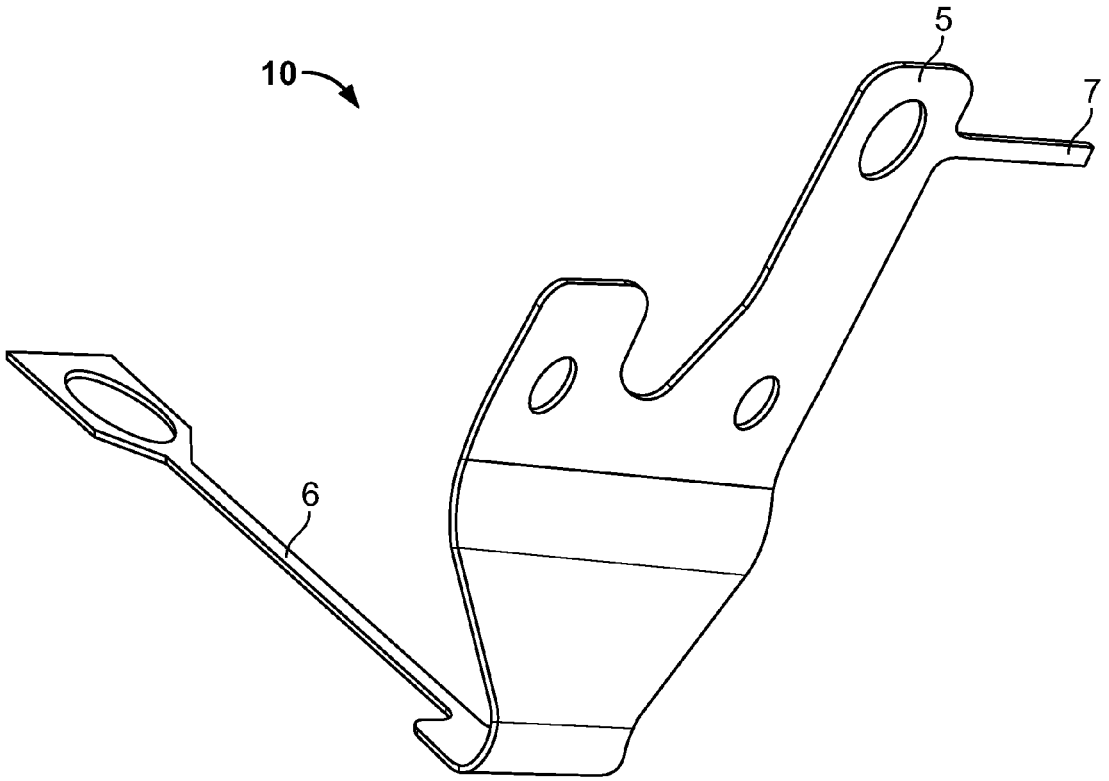
FIG. 8 is a schematic perspective view of a further embodiment of a spring element.

FIG. 8 shows a configuration of spring element 10 in which return spring 7 is arranged on contact spring 5. This allows a compact structure which is easy to manufacture. Return spring 7 is located to the side of contact spring 5. It lies in the same plane as contact spring 5. In another embodiment, return spring 7 can also project out of a plane formed by contact spring 5 or extend obliquely thereto. Such a configuration has the advantage that the return spring 7, in the first switching state, for example, during switching off or disengagement, damps the contact springs 5 and suppresses high-frequency whirring noises of the contact spring 5. As a result of the integration of the return spring 7 with the contact spring 5, the return spring 7 thus gains an additional function in the form of a damping element for the contact spring 5. This is particularly successful if the link is located close to the contact.

Figure 9:
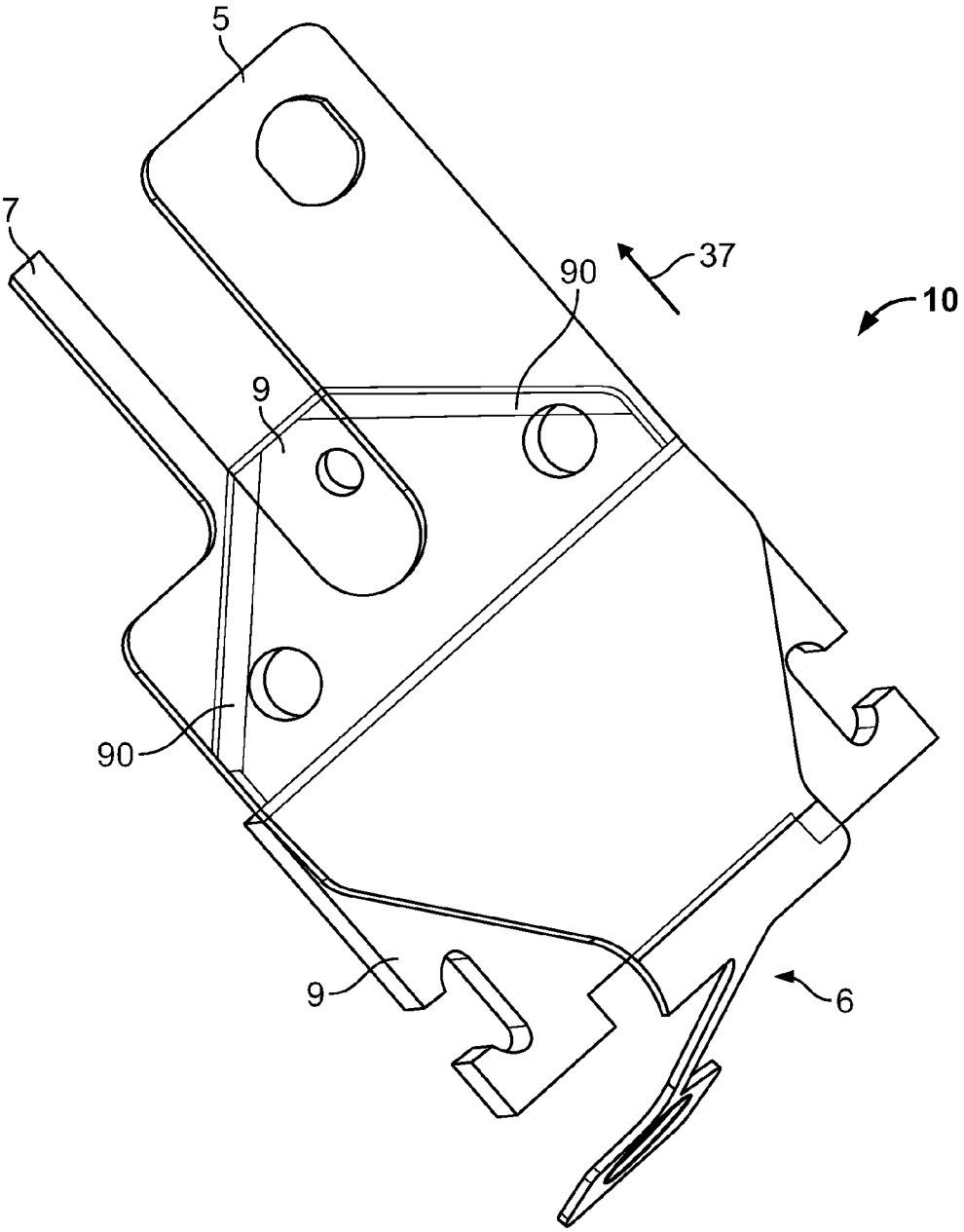
FIG. 9 is a schematic perspective view of a further embodiment of a spring element together with an armature.

A further advantageous configuration of a spring element 10 together with an advantageously configured armature 9 is represented in FIG. 9. Armature 9 has, in the regions in which contact spring 5 or return spring 7 abut against armature 9, two obliquely extending edges 90. Oblique edges 90 extend here at approximately 45° to extension directions 37 of contact spring 5 and return spring 7. As a result, the switching process can be made even quieter. In particular if armature 9 is moved together with contact spring 5 out of a closed state, as is represented as second switching position 200 in FIG. 1, and in which contact spring 5 is braced as a result of the contact force of armature 9, the oblique configuration prevents contact spring 5 from slapping loudly onto armature 9. Instead, contact spring 5 is rolled off gently and with little noise. The contact point between contact spring 5 and armature moves during this opening along oblique edge 90. The same applies to the connection between armature 9 and return spring 7. In order to enable an even more gentle rolling-off action and thus quieter switching, oblique edges 90 are additionally rounded towards contact spring 5 or towards the return spring 7.

The switching noise of a switching unit could be reduced with an arrangement with a return spring 7 by 3 dB (A) in comparison with a switching unit with a straight edge. In order to measure noise, the switching arrangement was plugged in a low-reflection, closed container with noise-absorbent walls and a reflecting base in an automotive plug base which was placed on a surface which is resiliently suspended. The switching unit was energized with 13.5 V and switched on again without a coil suppression. The switching noise was measured with a microphone at a 1 m distance from the switching unit within the container and evaluated via the A filter.

Figure 10:
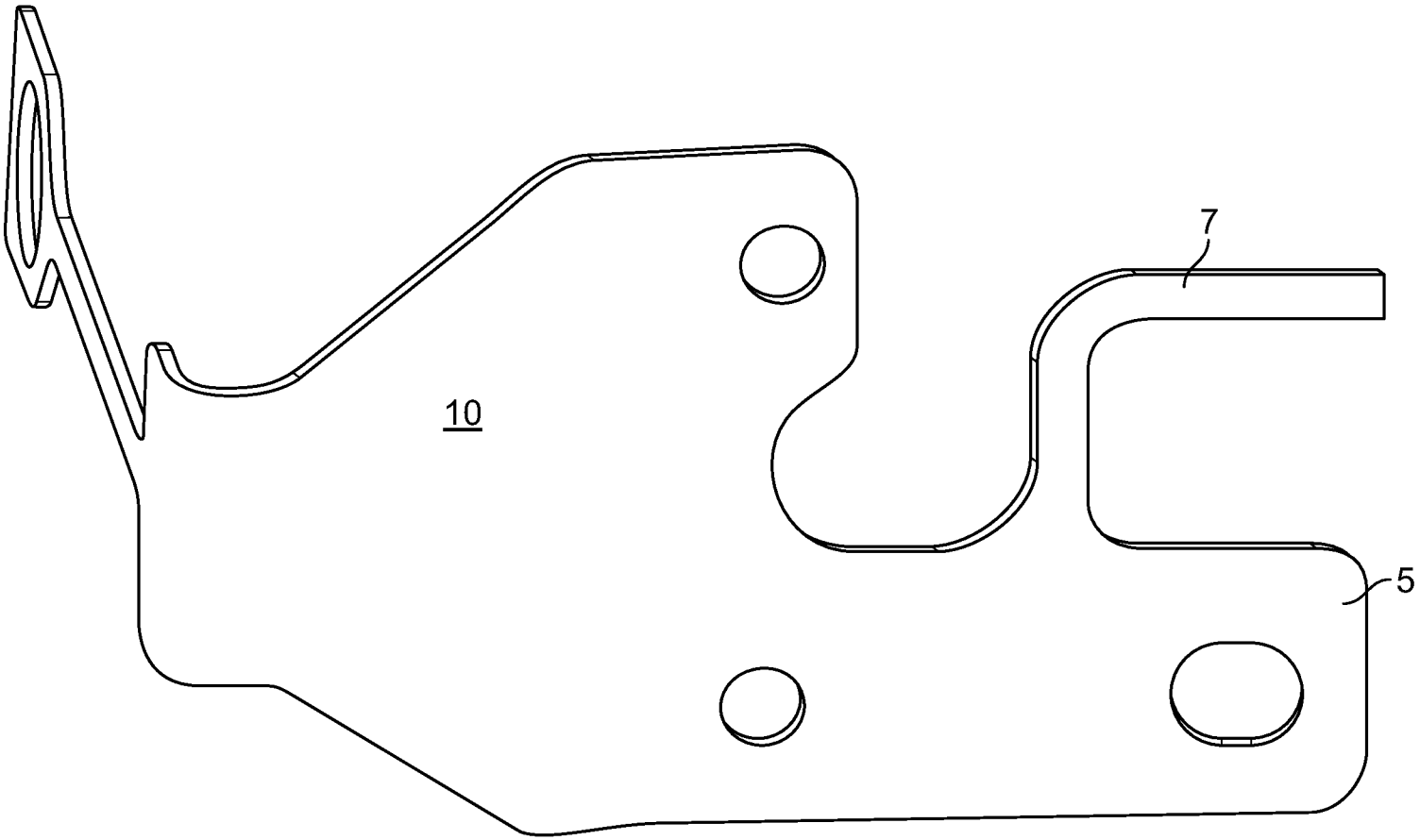
FIG. 10 is a schematic perspective view of a further embodiment of a spring element.

Another embodiment is represented in FIG. 10, in which return spring 7 is arranged on contact spring 5. Return spring 7 is configured in an L-shape and joined approximately centrally to contact spring 5. A first limb of the return spring extends perpendicularly away from contact spring 5 and forms a transition via a 90° curve into a second limb which extends parallel with contact spring 5. Together with contact spring 5, a U- or C-shaped configuration is produced. As a result of the joining of return spring 7 to contact spring 5, vibrations of contact spring 5, which can arise during opening, are effectively damped and the switching noise further reduced as a result.

Figure 11:
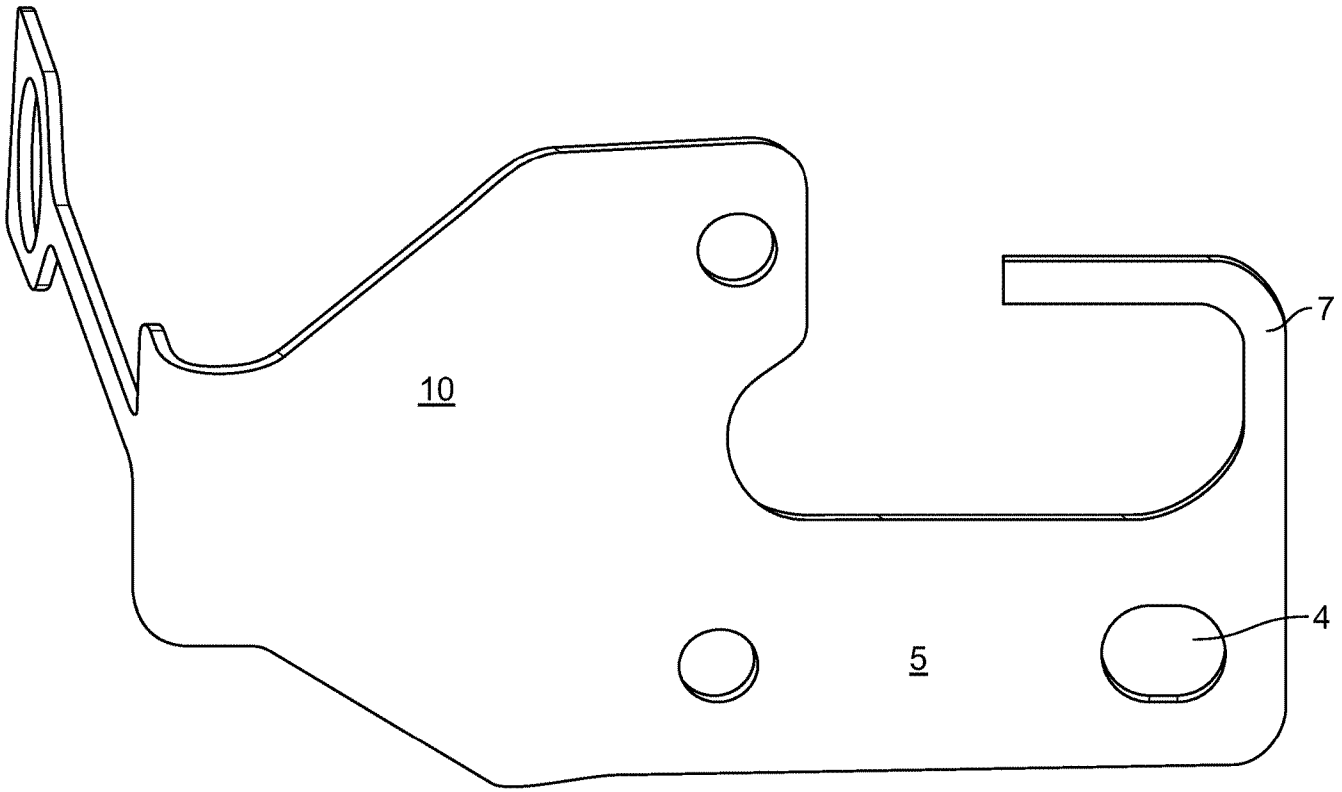
FIG. 11 is a schematic perspective view of a further embodiment of a spring element.

A further embodiment is represented in FIG. 11 in which return spring 7 is also arranged on contact spring 5. Joining is carried out here at the end of contact spring 5. In particular, joining is in the vicinity of contact opening 4 which serves to receive a contact element. Damping is particularly effective as a result. As in the case of the embodiment of FIG. 10, a first limb extends perpendicularly away from contact spring 5 and forms a transition via a curve into a second limb which extends parallel with contact spring 5. Overall, return spring 7 and contact spring 5 are together therefore once again C-shaped or U-shaped. In contrast to the embodiment of FIG. 10, however, the free end of return spring 7 projects inwards, that is to say, towards the rest of spring element 10. The length of the spring is increased as a result of the L-shaped configuration, as a result of which the damping properties and spring properties are changed. In particular, such a return spring 7 is more flexible than a short return spring 7.

Figure 12:
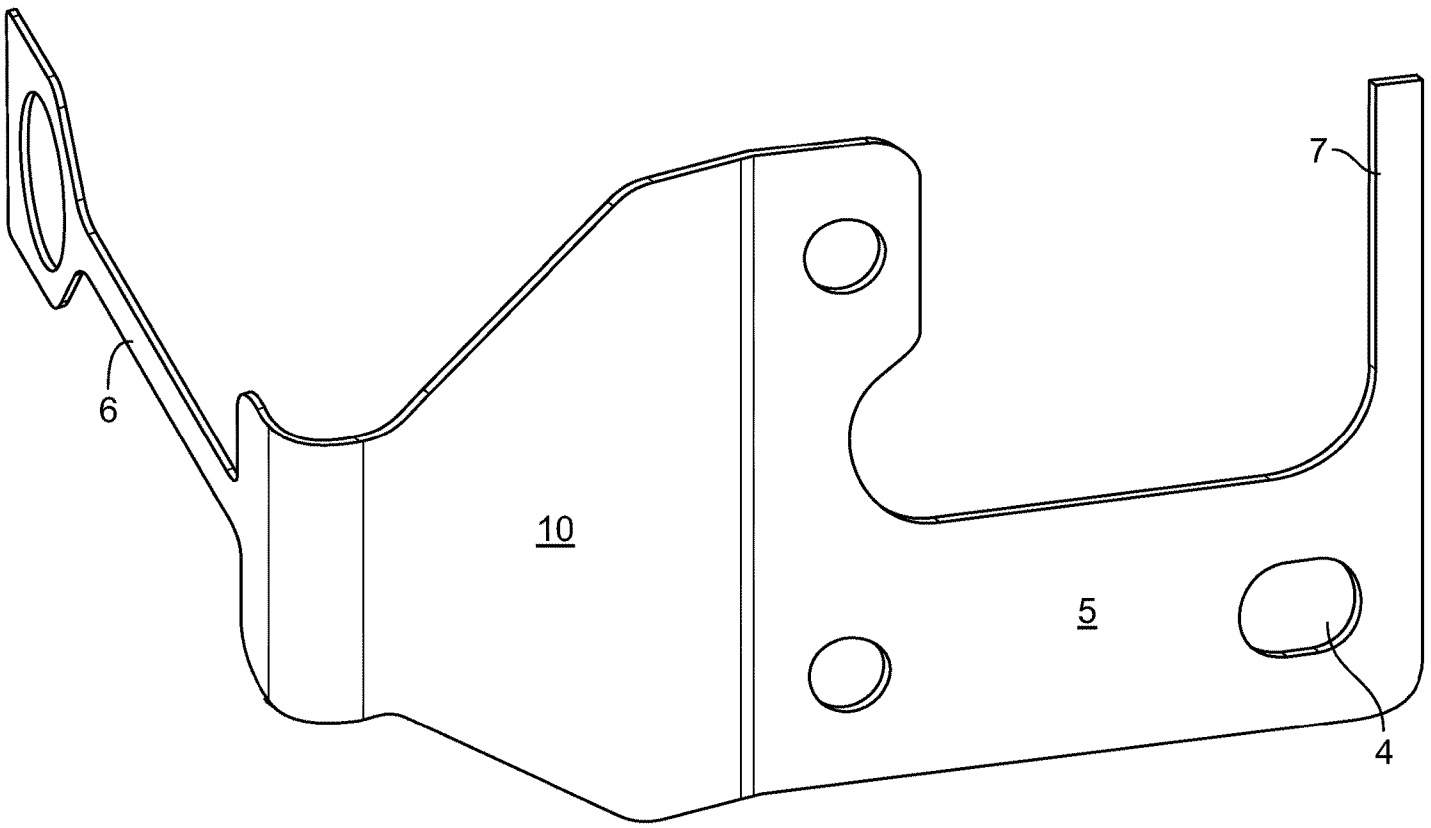
FIG. 12 is a schematic perspective view of a further embodiment of a spring element.

A further embodiment is represented in FIG. 12. As already shown in FIGS. 10 and 11, return spring 7 is again joined via contact spring 5. Joining is carried out here once again at the end of contact spring 5 and in particular in the vicinity of receptacle opening 4 for a contact element. Return spring 7 has a first limb which extends perpendicularly away from contact spring 5 so that an L-shaped configuration is produced overall. Such embodiments can be easier to produce than the embodiments shown in FIGS. 10 and 11.

Figure 13:
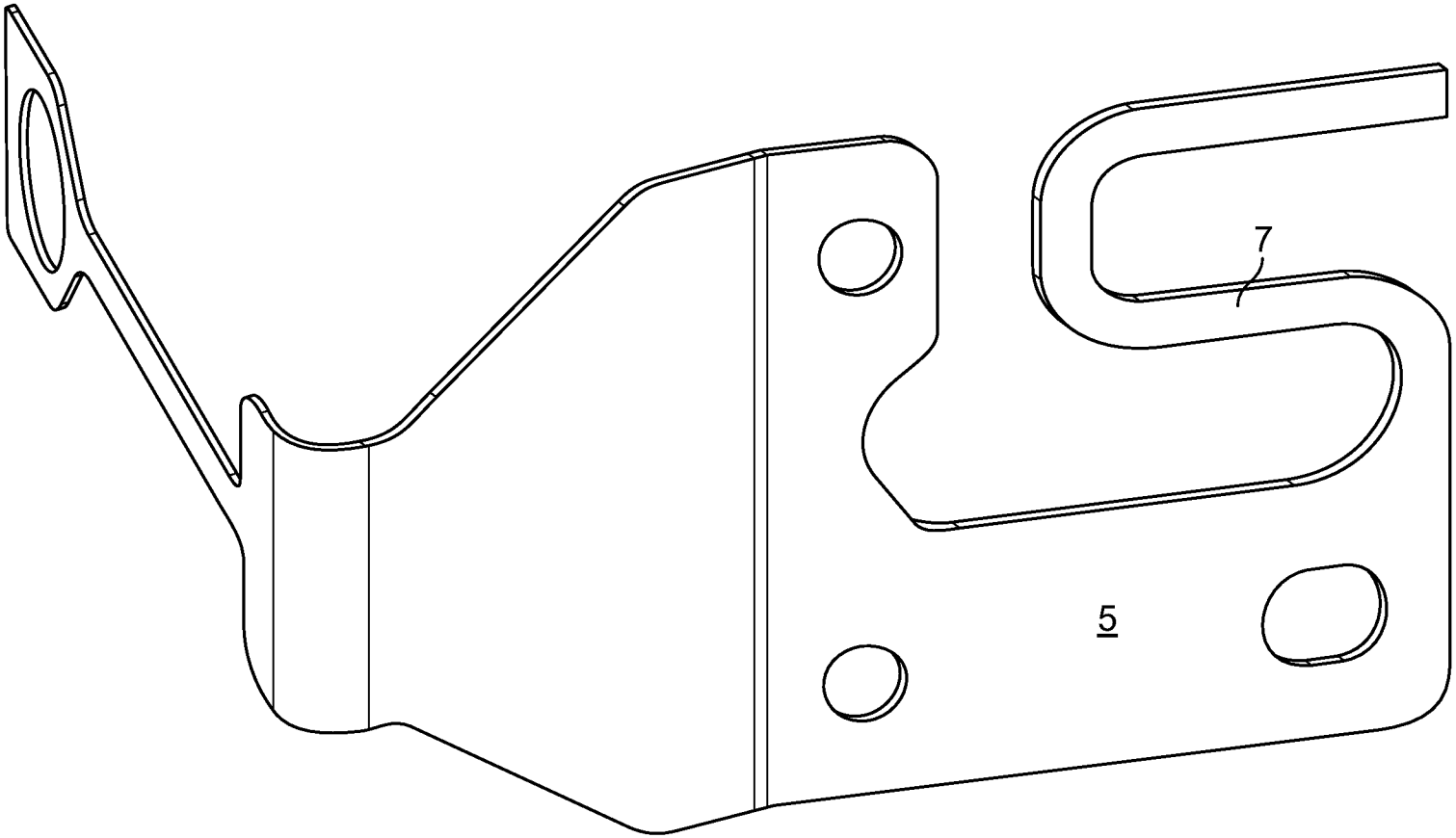
FIG. 13 is a schematic perspective view of a further embodiment of a spring element.

A further embodiment is represented in FIG. 13. Return spring 7 extends here in an S-shape or meandering manner in order to achieve a long spring length. The joining of return spring 7 is carried out again at the end of contact spring 5. A first limb again extends perpendicularly away from contact spring 5 and forms a transition via a curve into a second limb which in turn forms a transition via a curve into a third limb. It then forms a transition via a further curve into a fourth limb which extends parallel with contact spring 5.

Figure 14:
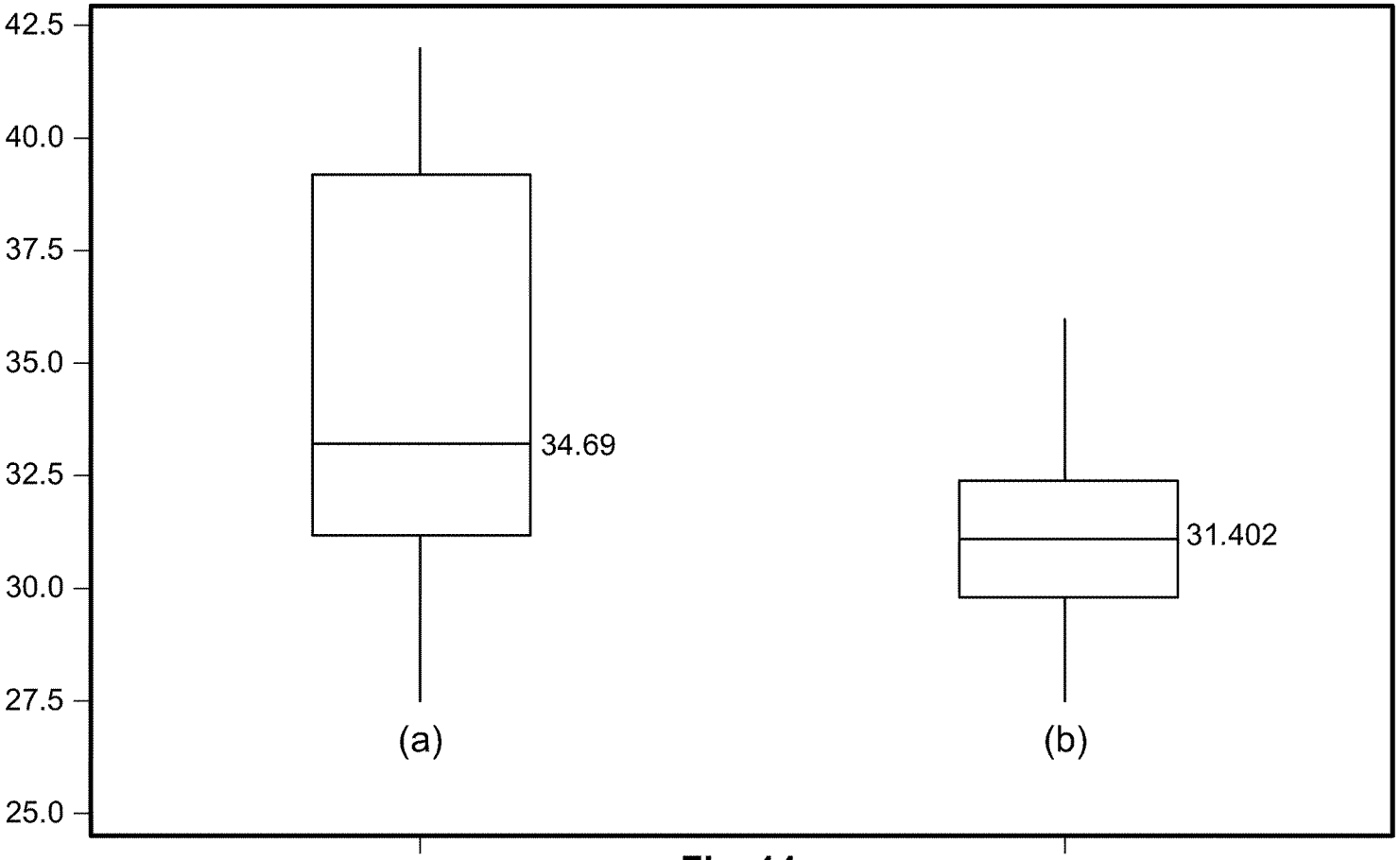
FIG. 14 is a graph which shows the further noise reduction by the embodiments of FIGS. 8 and 10 to 13.

A comparison between an embodiment in which return spring 7 is not arranged on contact spring 5 (left, a), as shown in FIGS. 1, 4-7, and 9, and an embodiment in which return spring 7 is arranged on contact spring 5 (right, b), as shown in FIGS. 8 and 10-13, is represented in FIG. 14. A further reduction in the switching noise by 3.3 dB is achieved by the joining of return spring 7 via contact spring 5.

What is claimed is:

1. An arrangement for an electric switching device, comprising:

a switching unit having an armature and a contact spring and movable between a first switching position and a second switching position;

a restoring element exerting a restoring force on the switching unit in the second switching position, the restoring force directed toward the first switching position;

a non-adjustable supporting surface;

a return spring integrally formed with the contact spring and the restoring element, the return spring and the contact spring are attached to the armature, the return spring having a first planar surface contacting the non-adjustable supporting surface in both the first switching position and the second switching position and exerting a counterforce on the switching unit opposite to the restoring force, the return spring does not overlap any portion of the contact spring in a direction perpendicular to the first planar surface of the return spring, a second planar surface of the contact spring extending parallel to the first planar surface of the return spring in a state in which the contact spring and the return spring are undeflected; and a coil body with a coil core generating a magnetic field attracting the armature, the armature is movable with respect to the coil body and is disposed between a portion of the return spring and a portion of the coil body with which the non-adjustable supporting surface is integrally formed, an end of the return spring is disposed between the coil body and the non-adjustable supporting surface.

2. The arrangement for an electric switching device of claim 1, wherein the counterforce and restoring force cancel each other in the first switching position.

3. The arrangement for an electric switching device of claim 2, wherein the return spring and contact spring project on the same side of the switching unit.

4. The arrangement for an electric switching device of claim 3, wherein the contact spring and return spring have parallel limbs.

5. The arrangement for an electric switching device of claim 3, wherein the return spring is a curved shape with an end section extending parallel with the contact spring.

6. The arrangement for an electric switching device of claim 5, wherein the return spring has an S-shape.

7. The arrangement for an electric switching device of claim 3, wherein the return spring has a smaller spring constant than that of the contact spring.

8. The arrangement for an electric switching device of claim 2, wherein the return spring is pretensioned.

9. The arrangement for an electric switching device of claim 2, wherein the return spring extends from the contact spring.

10. The arrangement for an electric switching device of claim 9, wherein the return spring is joined approximately centrally to the contact spring.

11. The arrangement for an electric switching device of claim 9, wherein the return spring is joined at an end of the contact spring.

12. An arrangement for an electric switching device, comprising:

a switching unit having an armature and a contact spring and movable between a first switching position and a second switching position;

a restoring element exerting a restoring force on the switching unit in the second switching position, the restoring force directed toward the first switching position;

a supporting surface;

a return spring integrally formed with the contact spring and the restoring element, the return spring and the contact spring are attached to the armature, the return spring having a first planar surface contacting the supporting surface in both the first switching position and the second switching position and exerting a counterforce on the switching unit opposite to the restoring force, a second planar surface of the contact spring extending in a same plane defined by the first planar surface of the return spring in a state in which the contact spring and the return spring are undeflected; and a coil body with a coil core generating a magnetic field attracting the armature, the armature is movable with respect to the coil body and is disposed between a portion of the return spring and a portion of the coil body with which the supporting surface is integrally formed, an end of the return spring is disposed between the coil body and the supporting surface.

* * * * *